US009718114B2

(12) United States Patent
Itaya

(10) Patent No.: US 9,718,114 B2
(45) Date of Patent: Aug. 1, 2017

(54) WIRE FORMING APPARATUS

(71) Applicant: KABUSHIKI KAISHA ITAYA SEISAKU SHO, Matsudo-shi, Chiba-ken (JP)

(72) Inventor: Ichiro Itaya, Matsudo (JP)

(73) Assignee: KABUSHIKI KAISHA ITAYA SEISAKU SHO, Chiba-ken (JP)

( * ) Notice: Subject to any disclaimer, the term of this patent is extended or adjusted under 35 U.S.C. 154(b) by 241 days.

(21) Appl. No.: 14/487,757

(22) Filed: Sep. 16, 2014

(65) Prior Publication Data

US 2015/0075244 A1 Mar. 19, 2015

(30) Foreign Application Priority Data

Sep. 17, 2013 (JP) ..... 2013-192338

(51) Int. Cl.

| | |
|---|---|
| ***B21F 35/00*** | (2006.01) |
| ***B21F 3/12*** | (2006.01) |
| ***B21F 3/02*** | (2006.01) |

(52) U.S. Cl.

CPC ..... *B21F 35/00* (2013.01); *B21F 3/02* (2013.01); *B21F 3/12* (2013.01)

(58) Field of Classification Search

CPC .... B21F 3/02; B21F 35/00; B21F 1/00; B21F 1/008; B21F 3/00; B21F 1/006; B21F 35/02; B21F 99/00

See application file for complete search history.

(56) References Cited

U.S. PATENT DOCUMENTS 5,203,191 A 4/1993 Maggi
7,024,901 B2 * 4/2006 Yamaguchi ..... B21F 3/02 72/137

(Continued)

FOREIGN PATENT DOCUMENTS

JP S63207433 A 8/1988
JP H04226844 A 8/1992

(Continued)

OTHER PUBLICATIONS

Machine translation from Proquest and original document of JP2007044707A is attached.*

(Continued)

*Primary Examiner* — Peter DungBa Vo
*Assistant Examiner* — John S Lowe
(74) *Attorney, Agent, or Firm* — Merchant & Gould P.C.

(57) ABSTRACT

A wire forming apparatus which feeds out a wire to a formation space at a distal end of a wire guide (333) and works the wire into a desired shape by using radially arranged tools (T1-T4) includes a wire feeder (30) which supports the wire guide (333) and feeds out the wire to the wire guide (333), tool rotating means (230), from which the tool (T1-T4) is detachable, for changing a position of the tool (T1-T4) relative to the wire guide (333) by rotation, tool driving means (240), rotatably supported by the tool rotating means (230), for applying a driving force to the tool (T1-T4) attached to the tool rotating means (230), a table (210, 220) which supports the tool rotating means (230) and the tool driving means (240) and is configured to move in a two-dimensional direction, and control means (701) for controlling operations of the wire feeder (30), the tool rotating means (230), the tool driving means (240), and the table (210, 220) to work the wire into a desired shape.

6 Claims, 7 Drawing Sheets

(56) References Cited

U.S. PATENT DOCUMENTS

| | | | |
|---|---|---|---|
| 8,166,786 | B2 | 5/2012 | Speck |
| 8,336,353 | B2 | 12/2012 | Tsuritani |
| 8,393,191 | B2 | 3/2013 | Itaya |
| 8,770,002 | B2 | 7/2014 | Takahashi |

FOREIGN PATENT DOCUMENTS

| | | | | |
|---|---|---|---|---|
| JP | 2004237352 | A | | 8/2004 |
| JP | 2007030038 | A | | 2/2007 |
| JP | 2007044707 | A | * | 2/2007 |
| JP | 2009012074 | A | | 1/2009 |
| JP | 2011016150 | A | | 1/2011 |
| JP | 05-148759 | | | 12/2012 |
| JP | 2013022631 | A | | 2/2013 |

OTHER PUBLICATIONS

Original document JP 2007044707 A is attached.*
Machine translation for JP 2007044707 A is attached.*
Japanese Office Action dated Feb. 9, 2015 for corresponding Japanese Patent Application No. 2013-192338, filed Sep. 17, 2013, 11 pages.
Japanese Office Action dated Jul. 25, 2014 for corresponding Japanese Patent Application No. 2013-192338, filed Sep. 17, 2013, 4 pages.

* cited by examiner

WIRE FORMING APPARATUS

CROSS-REFERENCE TO RELATED APPLICATION

This application is claims the benefit of priority to Japanese Patent Application No. 2013-192338, filed Sep. 17, 2013, the disclosure of which is hereby incorporated by reference in its entirety. To the extent appropriate, a claim of priority is made to the above disclosed application.

BACKGROUND OF THE INVENTION

Field of the Invention

The present invention relates to a wire forming apparatus which works a wire into a desired shape.

Description of the Related Art

A conventional wire forming apparatus sometimes needs to perform a process of rotating a fed wire in addition to a process of bending, curving, or winding the wire in order to work the wire into a final product shape. The conventional wire forming apparatus performs a process of rotating a wire by using feed rollers which feed the wire to a forming table. That is, this apparatus rotates a wire by making a pair of feed rollers pivot around the wire axis through a desired angle while compressing the wire between the pair of feed rollers. An advantage in rotating a wire is that it is possible to easily form the wire in an arbitrary direction. In other words, when not rotating a wire, it is necessary to change the mount positions of tools.

The long wire supplied from a material maker is held while being wound around a wire supply mechanism. For this reason, the wire has a curving tendency with a large curvature so as to curve in the winding direction. A curving tendency correction mechanism corrects this curving tendency to some extent when feeding out the wire, but cannot completely eliminate the tendency. For this reason, if a thin wire having a wire diameter of about 0.3 mm or less, in particular, is rotated with this tendency remaining, the direction of the curving tendency changes vertically or horizontally every time it is rotated. This affects the working of the wire, leading to, for example, variations in final product shape. In the process of rotating the wire, although the wire is compressed by the pair of feed rollers, rotating the wire repeatedly for a long period of time will cause a slight slip between the feed rollers and the wire. The accumulation of such slips will make product shapes unstable. In addition, the above process of rotating the wire twists the wire between a rotating wire supply mechanism and the feed rollers. This influences the stability of product shapes. Although securing a sufficient distance from the wire supply mechanism to the feed rollers can reduce the influence of twisting, it is not possible to completely eliminate the influence. The smaller the line diameter of a wire, the greater the influence.

For example, Japanese Patent No. 5148759 has proposed a wire forming apparatus which can rotate a tool around the axis of a wire without adding any process of rotating the wire. Japanese Patent No. 5148759 discloses a structure in which a plurality of tool slides 16 are radially arranged on a swivel table 10, and driving mechanisms corresponding to the number of the tool slides 16 are radially arranged on a forming table 2 around the swivel table 10.

According to Japanese Patent No. 5148759, the plurality of tool slides 16 are radially arranged on the swivel table 10, and the driving mechanisms corresponding to the number of the tool slides 16 are radially arranged on the forming table 2 around the swivel table 10.

In order to always make a tool drivable regardless of the rotational position of the swivel table 10, driving mechanisms corresponding to the number of tool slides 16 need to be arranged on the forming table 2. In addition, according to Japanese Patent No. 5148759, when rotating the swivel table 10 to which the tool slides 16 are attached, it is necessary to retract the driving mechanisms on the forming table 2 backward.

SUMMARY OF THE INVENTION

The present invention has been made in consideration of the above problem, and has as its object to realize a wire forming apparatus which can rotate tools around the axis of a wire without making the number of driving mechanisms limit a rotational position or performing any retracting operation.

In order to solve the above problem and achieve the above object, a wire forming apparatus according to the present invention which feeds out a wire to a formation space at a distal end of a wire guide (333) and works the wire into a desired shape by using radially arranged tools (T1-T4) includes a wire feeder (30) which supports the wire guide (333) and feeds out the wire to the wire guide (333), tool rotating means (230), from which the tool (T1-T4) is detachable, for changing a position of the tool (T1-T4) relative to the wire guide (333) by rotation, tool driving means (240), rotatably supported by the tool rotating means (230), for applying a driving force to the tool (T1-T4) attached to the tool rotating means (230), a table (210, 220) which supports the tool rotating means (230) and the tool driving means (240) and is configured to move in a two-dimensional direction, and control means (701) for controlling operations of the wire feeder (30), the tool rotating means (230), the tool driving means (240), and the table (210, 220) to work the wire into a desired shape.

According to the present invention, it is possible to realize a wire forming apparatus which can rotate tools around the axis of a wire without making the number of driving mechanisms limit a rotational position or performing any retracting operation.

Other scopes and advantage besides those discussed above shall be apparent to those skilled in the art from the description of an embodiment of the invention as follows. In the description, reference is made to accompanying drawings, which form apart thereof, and which illustrate an example of the invention. Such example, however, is not exhaustive of the various embodiments of the invention, and therefore reference is made to the claims which follow the description for determining the scope of the invention.

DESCRIPTION OF THE EMBODIMENTS

An embodiment of the present invention will be described in detail with reference to the accompanying drawings. Although the following description is an example in which a wire forming apparatus of the present invention is applied to a spring manufacturing apparatus which forms a wire into a spring of a desired shape, the wire forming apparatus can be applied to apparatuses which form components other than springs.

[Apparatus Configuration]

The configuration and functions of the spring manufacturing apparatus according to this embodiment will be described first with reference to FIGS. 1A-1B to 4A-4C.

Figure 1B:
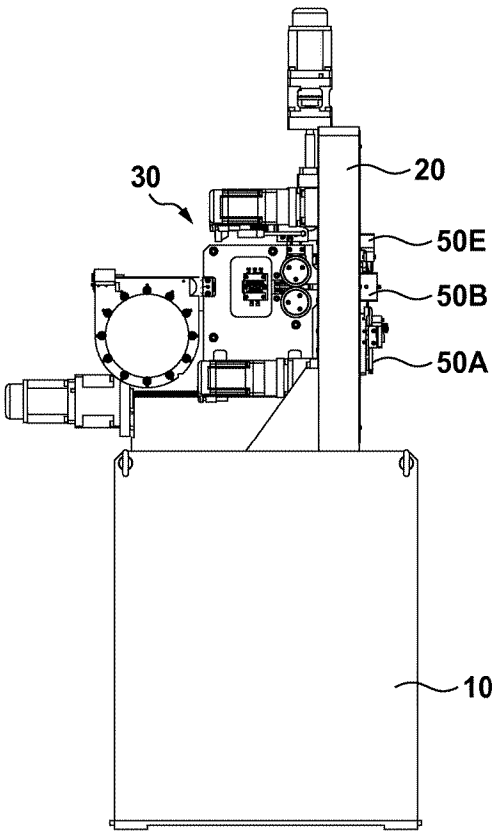
FIG. 1B shows a side view of a state in which a cover is attached to the forming table of a spring manufacturing apparatus according to an embodiment.
Figure 1A:
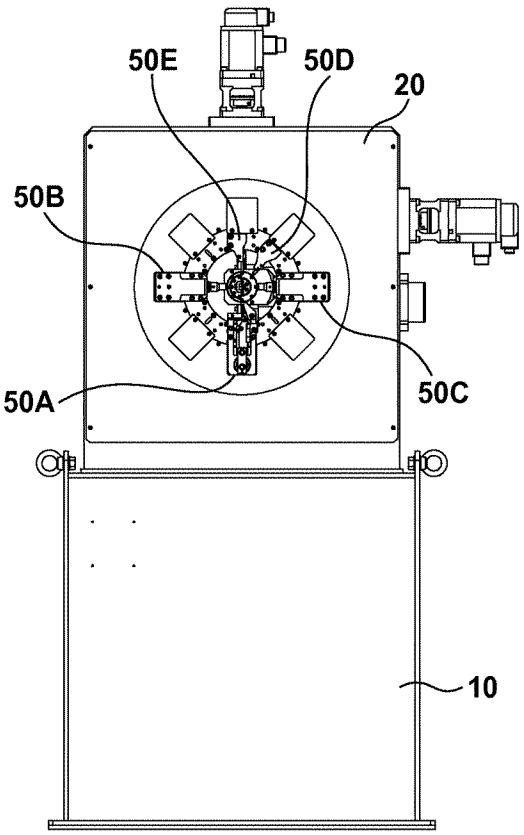
FIG. 1A shows a front view of a state in which a cover is attached to the forming table of a spring manufacturing apparatus according to an embodiment.
Figure 2B:
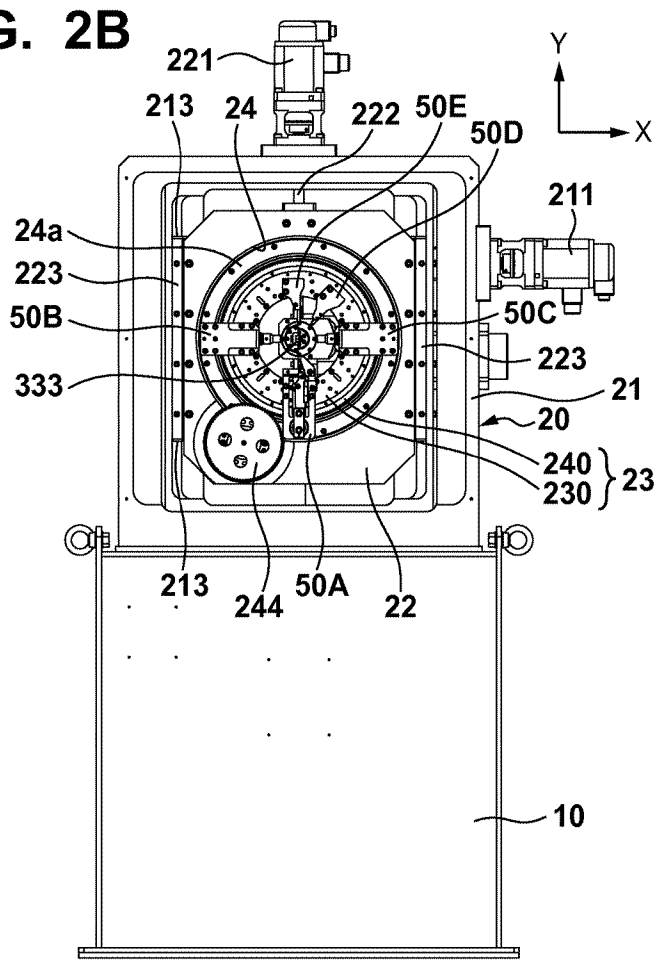
FIG. 2B shows a front view of a state in which the cover is removed from the forming table of the spring manufacturing apparatus according to this embodiment.
Figure 2A:
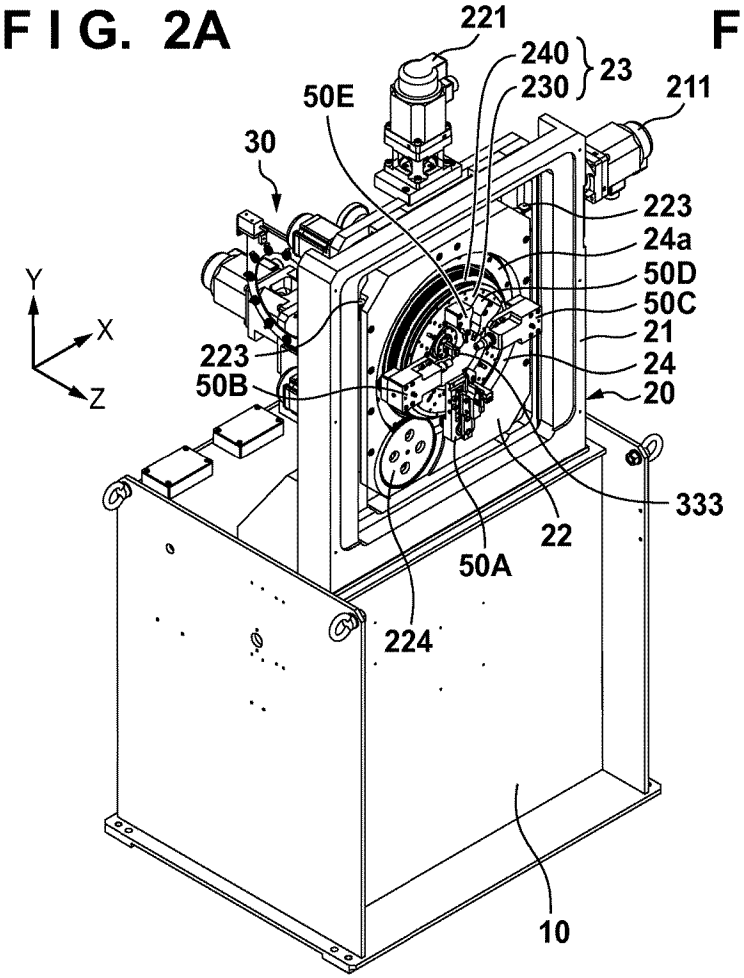
FIG. 2A shows a perspective view of a state in which the cover is removed from the forming table of the spring manufacturing apparatus according to this embodiment.
Figure 3A:
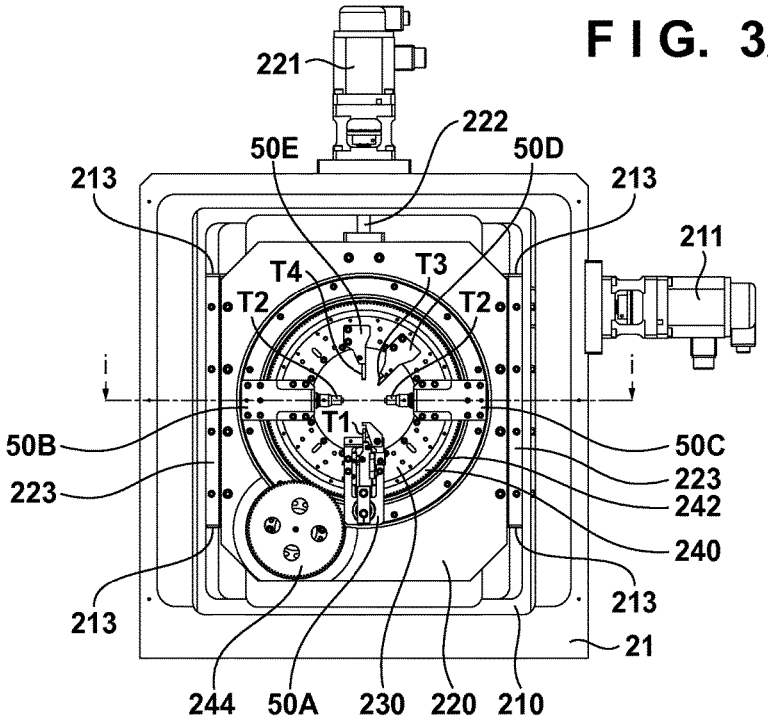
FIG. 3A shows a front view of the formation table in FIGS. 1A and 1B.
Figure 3B:
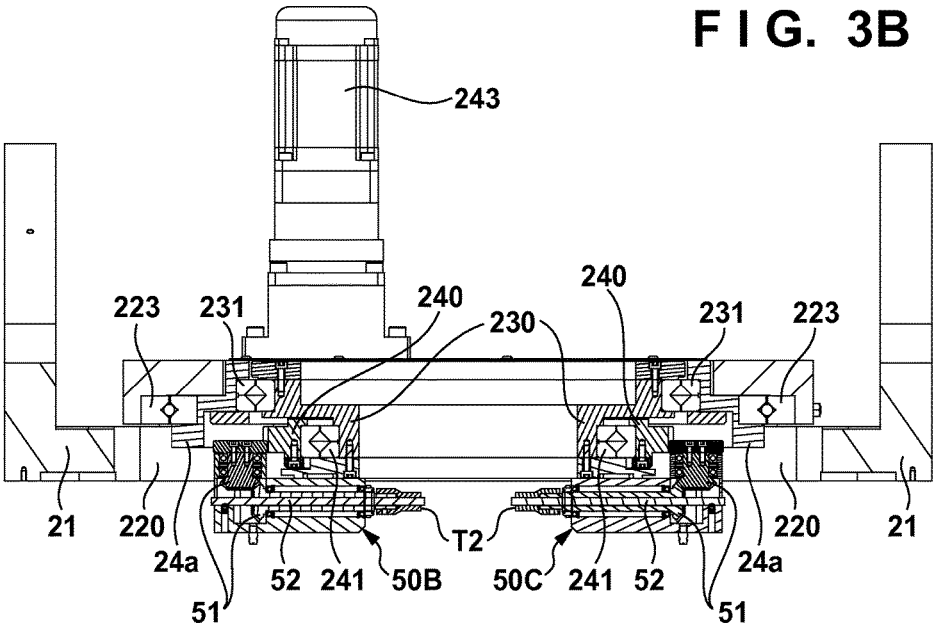
FIG. 3B shows an i-i sectional view of the formation table in FIG. 3A.
Figure 4A:
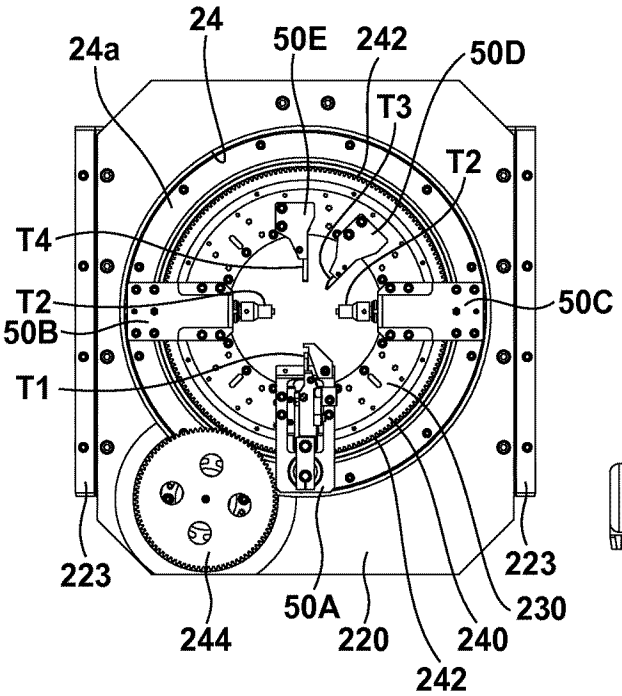
FIG. 4A shows a front view of a movable table and a rotating table in FIGS. 1A and 1B.
Figure 4B:
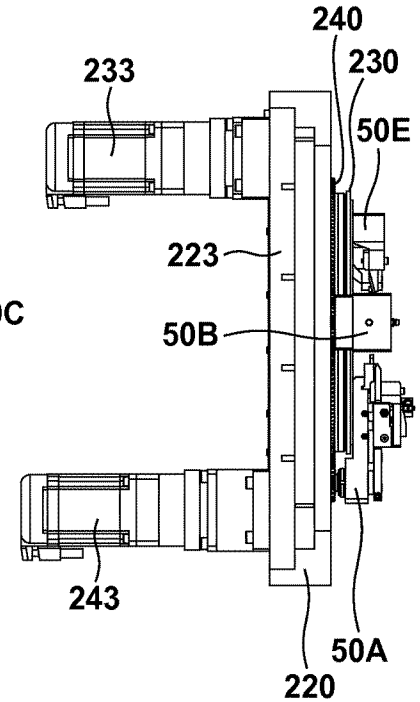
FIG. 4B shows a side view of a movable table and a rotating table in FIGS. 1A and 1B.
Figure 4C:
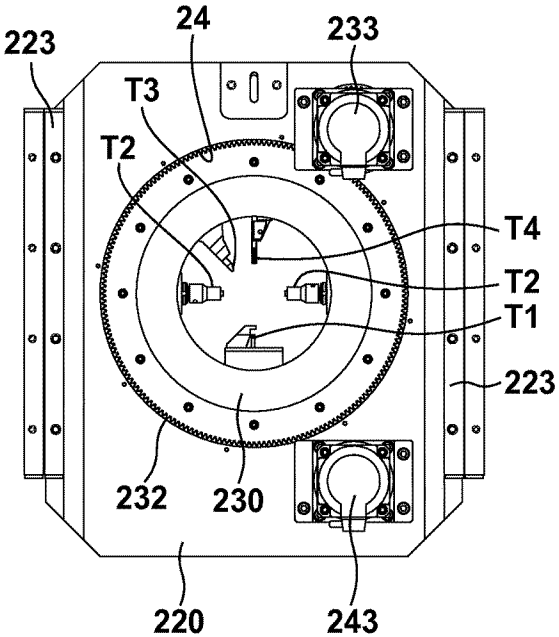
FIG. 4C shows a rear view of a movable table and a rotating table in FIGS. 1A and 1B.

As shown in FIGS. 1A-1B, the spring manufacturing apparatus according to this embodiment includes a box-like base 10, a forming table 20 attached to an upper portion of the box-like base 10, and a wire feeder 30 arranged on the rear surface of the forming table 20.

The forming table 20 includes a rectangular table frame 21 forming an outer frame, a movable table 22 arranged inside the table frame 21, and a rotating table 23 arranged on the central portion of the movable table 22.

The movable table 22 includes an X table 210 supported on the table frame 21 and a Y table 220 supported on the X table 210. Note that the movable table 22 also serves as the Y table 220.

The X table 210 is supported through a pair of X rails 213 vertically provided in the X direction of the table frame 21, and can be moved in the X direction by the driving force of an X table driving mechanism 211 provided on a side portion of the table frame 21. The X table driving mechanism 211 can move the X table 210 by a preset distance in the X direction by transmitting the rotation of a servo motor to the X table 210 through a ball screw mechanism and the like in accordance with a control command from a controller (to be described later with reference to FIG. 7).

In addition, the Y table 220 is supported through a pair of Y rails 223 horizontally provided in the Y direction of the X table 210, and can be moved in the Y direction by an Y table driving mechanism 221 provided on an upper portion of the table frame 21. The Y table driving mechanism 221 can move the Y table 220 by a preset distance in the Y direction by transmitting the rotation of a servo motor to the Y table 220 through a ball screw mechanism 222 in accordance with a control command from the controller (to be described later with reference to FIG. 7).

The rotating table 23 includes a hollow disk-like tool rotating member 230 rotatably provided in a circular hollow portion 24 formed in the central portion of the movable table 22, and a ring-like tool driving member 240.

The tool rotating member 230 is rotatably axially supported through bearings 231 provided in an inner circumferential portion 24*a* of the hollow portion 24, and a gear 232 is formed throughout the outer circumferential portion of the hollow portion 24. One or a plurality of tool units (in this case, five tool units 50A to 50E) are detachably attached to the front surface of the tool rotating member 230. The tool rotating member 230 can be rotated through the gear 232 by the driving force of a tool rotating/driving mechanism 233 provided on the rear surface of the movable table 22. The tool rotating/driving mechanism 233 can make the tool rotating member 230 pivot to a preset angle by transmitting the rotation of a servo motor to the tool rotating member 230 through the gear 232 and the like in accordance with a control command from the controller (to be described later with reference to FIG. 7).

A tool driving member 240 is rotatably axially supported through bearings 241 provided in the tool rotating member 230, and forms a ring gear having a gear 242 formed throughout its outer circumferential portion. The tool driving member 240 can be rotated through the gear 242 by the driving force of a tool driving mechanism 243 provided on the rear surface of the movable table 22. The tool driving mechanism 243 can rotate the tool driving member 240 at a predetermined speed independently of the tool rotating member 230 by transmitting the rotation of a servo motor to the tool driving member 240 through a gear 244 and the like in accordance with a control command from the controller (to be described later with reference to FIG. 7).

The tool units 50A to 50E attached to the tool rotating member 230 include the slide tool unit 50A which slides a tool T1 toward a wire, the rotating tool units 50B and 50C which rotate tools T2 around their central axes, respectively, the coiling tool 50D which abuts against the wire to forcibly curve and wind it, and the cutting tool 50E which cuts the wire.

One or a plurality of tools T1 which forcibly bend a wire in cooperation with each other are attached to the slide tool unit 50A. The slide tool unit 50A includes an eccentric cam and slider for sliding the tool T1, and is rotated/driven to slide the tool T1 when the eccentric cam meshes with the gear 242 of the tool driving member 240 through a gear.

The tool T2 which forcibly winds a wire is rotatably attached to each of the rotating tool units 50B and 50C. The tool T2 is called a spinner. Each of the rotating tool units 50B and 50C includes a bevel gear pair 51 and shaft 52 for rotating the corresponding tool T2, and rotates/drives the tool T2 when one gear of the bevel gear pair 51 meshes with the gear 242 of the tool driving member 240.

A coiling tool T3 which abuts against a wire and forcibly curves and winds it is attached to the coiling tool unit 50D. A cutting tool T4 which cuts a wire by a shearing force in cooperation with a wire guide 333 is attached to the cutting tool 50E.

Figure 5A:
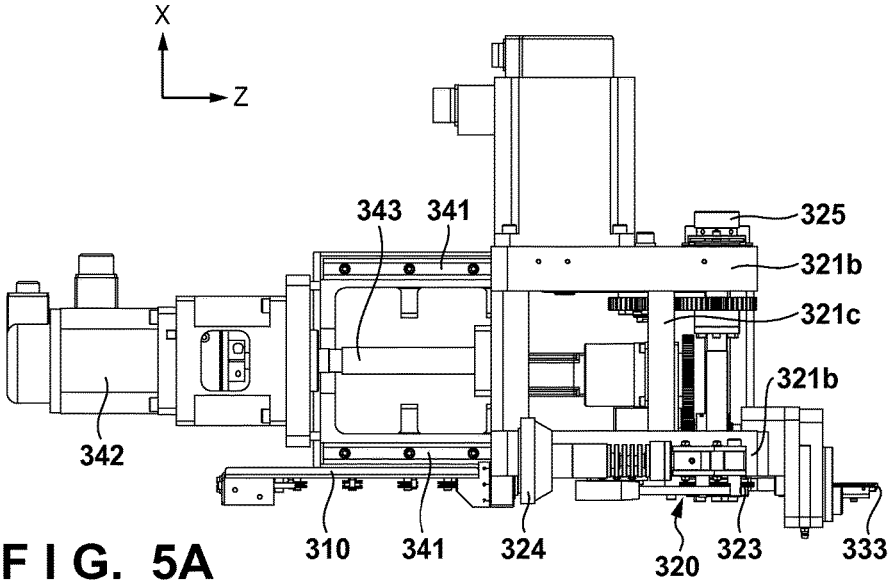
FIG. 5A shows a top view of a wire feeder in FIG. 1B.
Figure 5B:
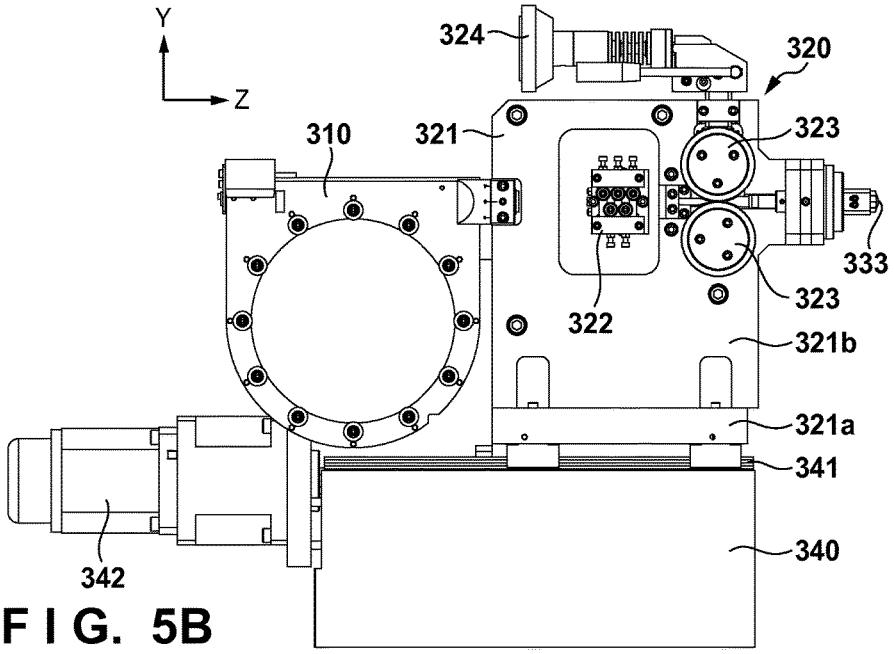
FIG. 5B shows a side view of a wire feeder in FIG. 1B.

As shown in FIGS. 5A-5B, the wire feeder 30 includes a wire supply mechanism 310 by which a wire is held while being wound and a wire feeding mechanism 320 which extracts the wire from the wire supply mechanism 310 and feeds it to the forming table 20. The wire supply mechanism 310 is held by the wire feeding mechanism 320 and is integrated with the wire feeding mechanism 320.

The wire feeding mechanism 320 includes a main body portion 321 having a pair of left and right side plates 321*b* coupled onto a lower base plate 321*a* at a predetermined distance from each other through a plurality of connecting portions 321*c*. The wire supply mechanism 310 is attached behind the main body portion 321.

A mechanism 322 which corrects the curving tendency of a wire and a pair of upper and lower feed rollers 323 are provided on a side surface of the main body portion 321 attached to the wire supply mechanism 310. A wire guide 333 is provided on the front surface of the main body portion 321.

The wire feeding mechanism 320 rotates while a wire is clamped by the pair of upper and lower feed rollers 323 to extract the wire from the wire supply mechanism 310 and guide the wire to the wire guide 333. The pressing force with which the feed rollers 323 clamp a wire can be adjusted by a handle 324 provided on an upper portion of the main body portion 321.

The wire guide 333 feeds out the wire fed out by the feed rollers 323 toward a spring formation space at the distal end portion. The space surrounded by the wire guide 333 and the tools T1 to T4 functions as the spring formation space. A feed roller driving mechanism 325 rotates/drives the feed rollers 323 in the wire feeding direction.

According to the above configuration, the tools T1 to T4 are rotated relative to the wire guide 333 by using the tool rotating member 230 but not making the wire guide 333 pivot instead. This makes it possible to change the spring formation space by changing the space on the inclined surface side of the wire guide 333, thereby forming a spring in a desired shape regardless of the positions of tools, as in the case of making the wire guide 333 pivot. In addition, since the movable table 22 can move the tool rotating member 230 in a two-dimensional direction, it is also possible to drive, for example, the coiling tool T3 or cutting tool T4 having no drive source in a two-dimensional direction.

A feeder moving mechanism 340 provided on the base 10 can move the wire feeder 30 in the wire feeding direction (Z direction) between the formation position where the wire guide 333 is located in the spring formation space and the retraction position where the wire guide 333 retracts from the spring formation space.

The feeder driving mechanism 340 can move the wire feeding mechanism 320 within a predetermined stroke range (about 120 mm) in the Z direction. The wire feeding mechanism 320 is provided to enable the lower base plate 321*a* of the main body portion 321 to move in the Z direction along a pair of left and right rails 341 provided on the feeder driving mechanism 340. The feeder driving mechanism 340 can move the wire feeding mechanism 320 by a preset distance in the Z direction by transmitting the rotation of a servo motor 342 to the main body portion 321 through a ball screw mechanism 343 and the like in accordance with a control command from a controller (to be described later with reference to FIG. 7).

The curving tendency correction mechanism 322 is constituted by a plurality of small-diameter rollers arranged in a staggered pattern. The curving tendency correction mechanism 322 feeds out the wire extracted from the wire supply mechanism 310 to the feed rollers 323 upon correcting the curving tendency of the wire.

The above configuration enables the wire feeding mechanism 320 to move in the wire feeding direction. This facilitates exchanging tools by sufficiently retracting the wire guide 333 from the spring formation space.

[Description of Operation]

The tool rotating/moving operation of the spring manufacturing apparatus according to this embodiment will be described next with reference to FIGS. 6A-6D.

Figure 6A:
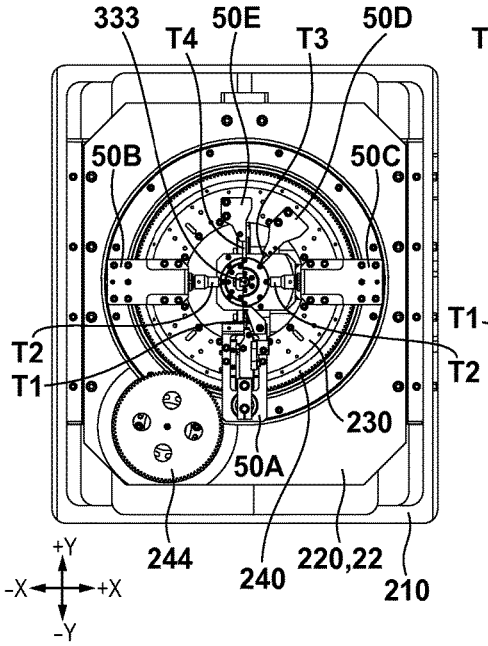
FIGS. 6A to 6D are views showing the movable table and the rotating table at the time of wire formation.
Figure 6B:
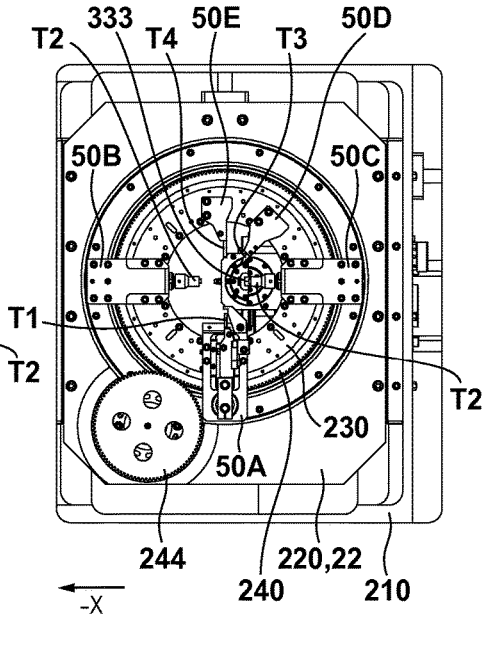

When the X table 210 moves the movable table 22 (Y table 220) in the −X direction with reference to the positional relationship between the wire guide 333 and each of the tools T1 to T4 shown in FIG. 6A, the state shown in FIG. 6B is set.

Figure 6C:
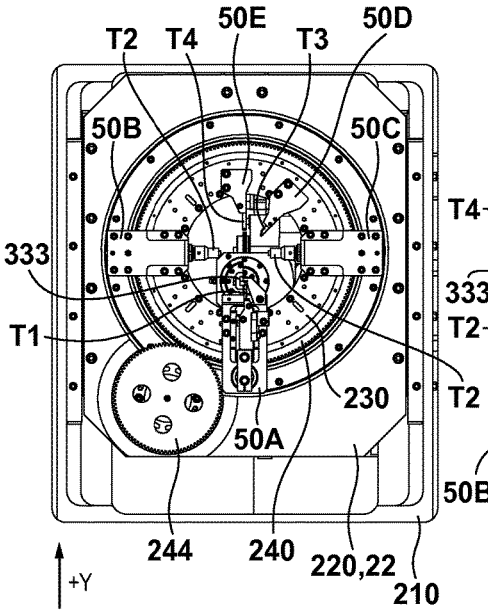

In addition, when the Y table 220 moves the movable table 22 in the +Y direction from the state shown in FIG. 6A, the state shown in FIG. 6C is set.

Figure 6D:
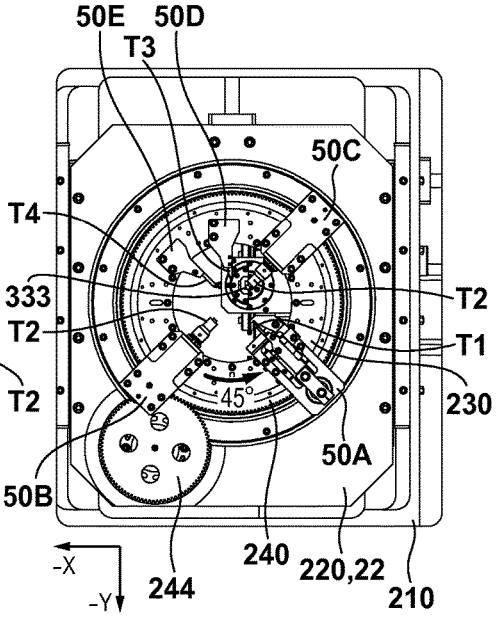

In addition, in the state of FIG. 6A, when the movable table 22 is moved in the −X direction by the X table 210 and moved in the −Y direction by the Y table 220, and the tool rotating member 230 is rotated counterclockwise through 45°, the state shown in FIG. 6D is set.

Note that while the state in FIG. 6A changes to the state in FIG. 6D, the tool driving member 240 can be rotated by the gear 244 independently of the tool rotating member 230, and it is possible to transmit driving forces to the tool units 50A and 50B regardless of the position of the tool rotating member 230, thereby ensuring the driving of the tools T1 and T2.

According to the above configuration, the movable table 22 is provided with the drive source common to a plurality of tools to enable the movable table 22 to move in a two-dimensional direction along a plane perpendicular to the wire axis and/or enable the rotating table 23 to pivot to an arbitrary angle while each tool is ready to be driven by the tool driving member 240. This obviates the necessity to provide drive sources for tools by the same number as that of tool units, and can rotate/move tools relative to the wire guide without, for example, making the position of the drive source impose any restrictions on the rotational position of a tool or performing any retracting operation.

[Configuration of Controller]

The configuration of the controller of the spring manufacturing apparatus according to this embodiment will be described next with reference to FIG. 7.

Figure 7:
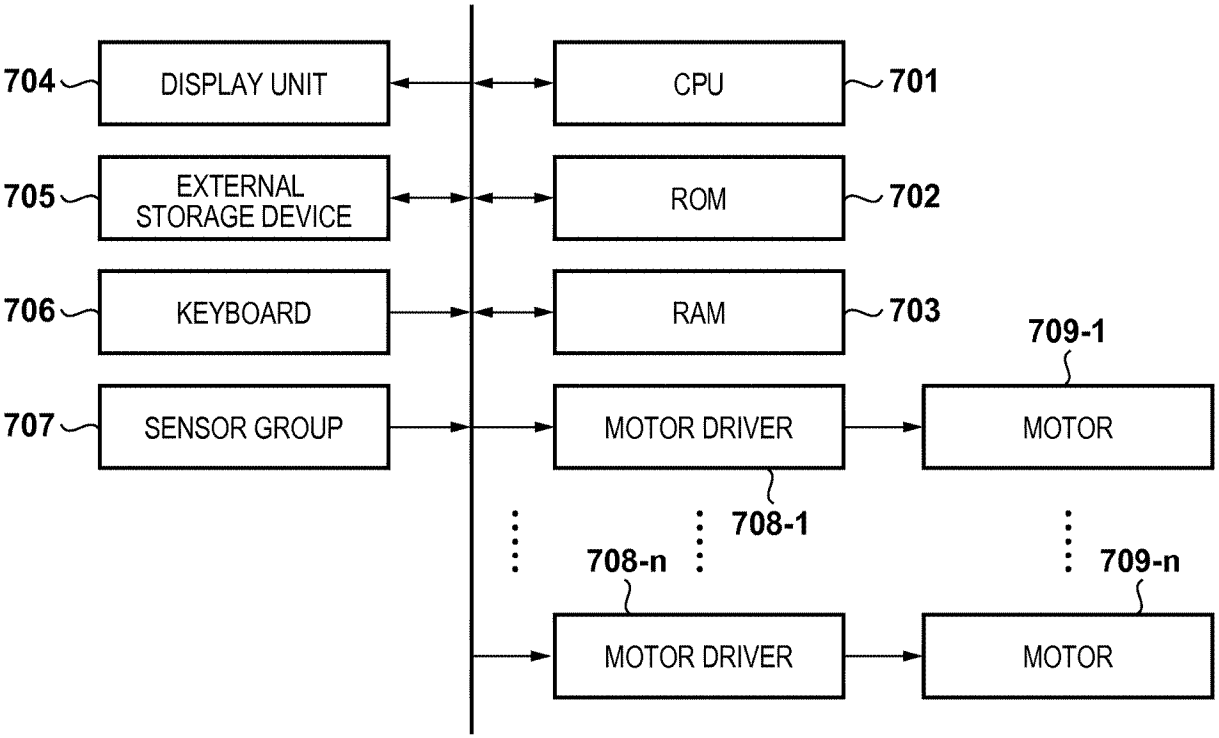
FIG. 7 is a block diagram of the control system of the spring manufacturing apparatus according to this embodiment.

As shown in FIG. 7, a CPU 701 comprehensively controls the overall controller. A ROM 702 stores operation processing contents (programs) of the CPU 701 and various font data. A RAM 703 is used as a work area for the CPU 701. A display unit 704 is provided to perform various settings, display their contents, and display the manufacturing process in the form of a graph. An external storage device 705 is a memory card and the like, which is used to externally supply a program and store the contents of various settings for a wire forming work. Consequently, storing parameters for a given forming work (for example, for a spring, its free length, diameter, and the like) makes it possible to always manufacture springs with the same shape by setting the memory card and executing a forming process.

A keyboard 706 is provided to set various parameters. A sensor group 707 is provided to detect the feed amount of wire, the free length of a spring, and the like.

Motors 708-1 to 708-n are equivalent to the servo motor of the X table driving mechanism 211, the servo motor of the Y table driving mechanism 221, the servo motor of the tool rotating/driving mechanism 233, the servo motor of the tool driving mechanism 243, the servo motor of the feed roller driving mechanism 325, and the servo motor 342 of the feeder driving mechanism 340. Motor drivers 709-1 to 709-n respectively corresponding to the motors 708-1 to 708-n drive them.

In this case, for example, the CPU 701 independently drives the respective motors, inputs/outputs data to/from the external storage device 705, and controls the display unit 704 in accordance with instructions input from the keyboard 706.

The present invention is not limited to the above embodiments and various changes and modifications can be made within the spirit and scope of the present invention. For example, the wire forming apparatus according to this embodiment can be used to work a wire having a line diameter exceeding 0.3 mm, and the types of tools can be arbitrarily changed in accordance with the line diameter of a wire and a product shape.

Therefore, to apprise the public of the scope of the present invention the following claims are made.

DESCRIPTION OF THE REFERENCE NUMERALS

10: base
20: forming table
22: movable table
23: rotating table
30: wire feeder
50A-50E: tool unit
210: X table
220: Y table
310: wire supply mechanism
320: wire feeding mechanism
333: wire guide
T1-T4: tool

What is claimed is:

1. A wire forming apparatus which feeds out a wire to a formation space at a distal end of a wire guide and works the wire into a desired shape by using radially arranged tools, comprising:

a wire feeder which supports the wire guide and feeds out the wire to the wire guide;

a rotating table having a tool rotating member, from which the tool is detachable, configured to change a position of the tool relative to the wire guide by rotation;

a tool driving member, rotatably supported by the tool rotating member, and configured to apply a driving force to the tool attached to the tool rotating member;

a movable table which supports the tool rotating member and the tool driving member and is configured to move in a two-dimensional direction; and a controller configured to control operations of the wire feeder, the tool rotating member, the tool driving member, and the movable table to work the wire into a desired shape, a feeder moving mechanism configured to move the wire feeder along a feeding direction of the wire, wherein the wire feeder is moved between a formation position where the wire guide is located in the formation space and a retraction position where the wire guide is retracted from the formation space, and the wire feeder is moved to the retraction position when exchanging the tool having no drive source and a tool unit attached to the tool rotating member;

wherein the movable table includes a first table which moves the tool rotating member in a first direction, a second table which moves in a second direction perpendicular to the first direction, a first table driving member which drives the first table, a second table driving member which drives the second table, and a main table which supports the first table, the second table, the first table driving member, and the second table driving member, the first table supports the tool rotating member and the tool driving member to be rotatable, the tool rotating member comprises a disk-like hollow member having a gear formed on an outer circumference thereof, and the tool having no drive source and the tool unit are detachable to a front surface of the tool rotating member, the tool driving member comprises a ring gear having a gear formed on an outer circumference thereof, the tool unit includes a rotating tool unit which winds the wire around a rotating tool, and a slide tool unit which bends the wire by sliding a slide tool, the movable table moves the tool unit in a two-dimensional direction in the formation space, and the gear of the tool driving member is a drive source common to the slide tool unit attached to the tool rotating member and the rotating tool unit so that at least the rotating tool rotates around its axis and the slide tool slides in its axial direction by a driving force of the gear of the tool driving member.

2. The wire forming apparatus according to claim 1, further comprising:

a first rotating/driving mechanism configured to rotate/drive the tool rotating member; and a second rotating/driving mechanism configured to rotate/drive the tool driving member, wherein the first rotating/driving mechanism rotates the tool rotating member through the gear using a driving force of a servo motor, and the second rotating/driving mechanism rotates the tool driving member by transmitting a driving force of a servo motor to the gear through a gear.

3. The wire forming apparatus according to claim 1, wherein the controller controls a relative positional relationship between the wire guide and the tool by rotating the tool rotating member through a predetermined angle, and controls driving of the tool unit by rotating the ring gear of the tool driving member at a predetermined speed.

4. The wire forming apparatus according to claim 1, wherein the wire feeder comprises a wire supply mechanism configured to supply the wire and a wire feeding mechanism configured to extract the wire from the wire supply mechanism and feed out the wire to the wire guide, and the feeder moving mechanism moves the wire feeder by using a driving force of a servo motor.

5. The wire forming apparatus according to claim 4, wherein the wire feeding mechanism comprises a curving tendency correction mechanism configured to correct a curving tendency of a wire extracted from the wire supply mechanism and a pair of feed rollers which clamp the wire whose curving tendency is corrected.

6. The wire forming apparatus according to claim 1, wherein the wire has a line diameter not more than 0.3 mm.

* * * * *